United States Patent [19]

Larimer et al.

[11] 4,307,845

[45] Dec. 29, 1981

[54] STRIKER BAR FOR ROTARY CAGE GRINDER

[75] Inventors: Thomas M. Larimer, Clairton; Joseph P. McGinness, McKeesport; Robert E. Parkinson, Monroeville Borough, all of Pa.

[73] Assignee: United States Steel Corporation, Pittsburgh, Pa.

[21] Appl. No.: 832,691

[22] Filed: Sep. 12, 1977

Related U.S. Application Data

[63] Continuation of Ser. No. 669,537, Mar. 23, 1976, abandoned, which is a continuation of Ser. No. 564,943, Apr. 3, 1975, abandoned.

[51] Int. Cl.[3] ..... B02C 13/28

[52] U.S. Cl. ..... 241/191; 241/197; 241/294

[58] Field of Search ..... 241/188 R, 191, 195, 241/197, 294, 298

[56] References Cited

U.S. PATENT DOCUMENTS

| | | | |
|---|---|---|---|
| 3,355,113 | 11/1967 | Meger et al. | 241/191 |
| 3,503,561 | 3/1970 | Johnson | 241/197 X |
| 3,612,420 | 10/1971 | Hull | 241/197 X |
| 3,659,793 | 5/1972 | Stephenson et al. | 241/197 X |

FOREIGN PATENT DOCUMENTS

| | | | |
|---|---|---|---|
| 726715 | 3/1955 | United Kingdom | 241/298 |

*Primary Examiner*—Howard N. Goldberg
*Attorney, Agent, or Firm*—William F. Riesmeyer, III

[57] ABSTRACT

A striker bar for a rotary cage grinder in which the impact-receiving portions of the bar are of an abrasion resistant ceramic, such as aluminum oxide, silicon carbide, or tungsten carbide. The bar includes a block of the ceramic, preferably formed in sections abutting end-to end, adhesively affixed to an angle iron mounting, which is removably attached to supporting structural members in the cage.

3 Claims, 3 Drawing Figures

FIG. 1.
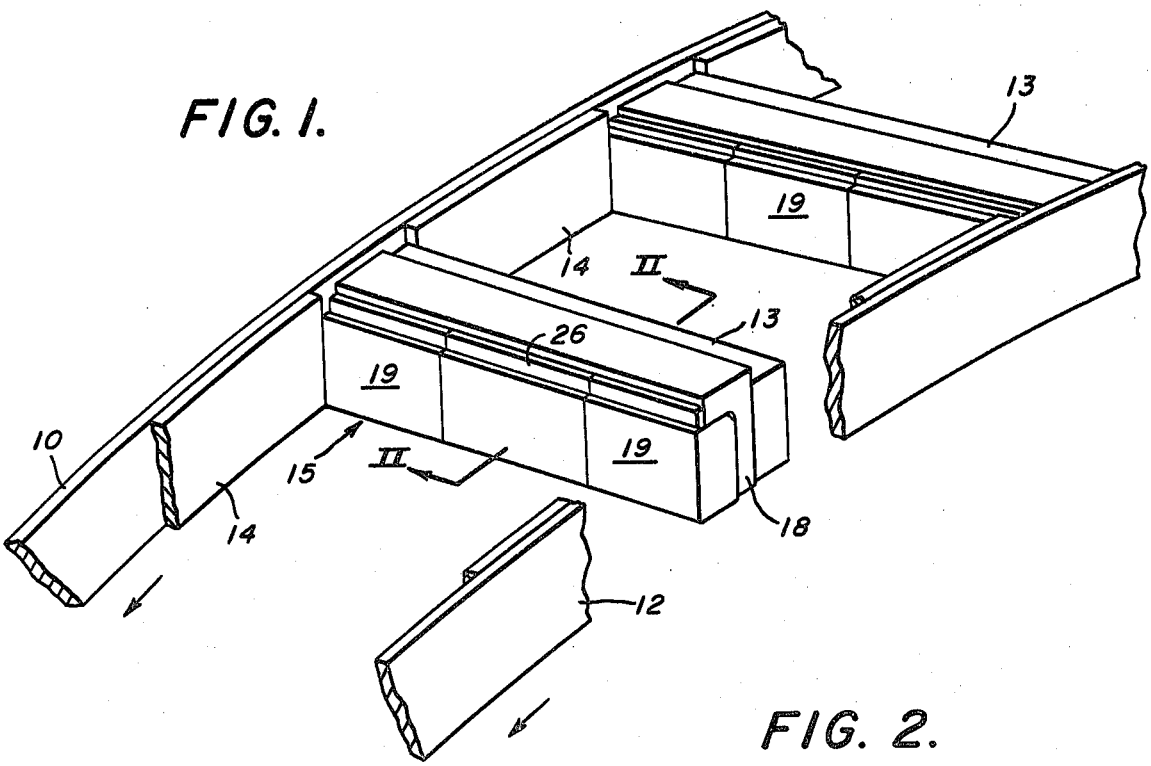
FIG. 2.
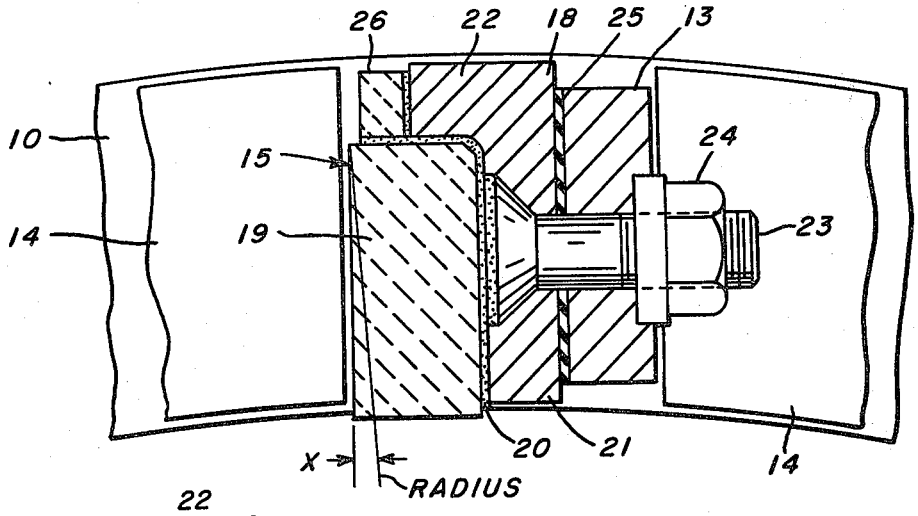
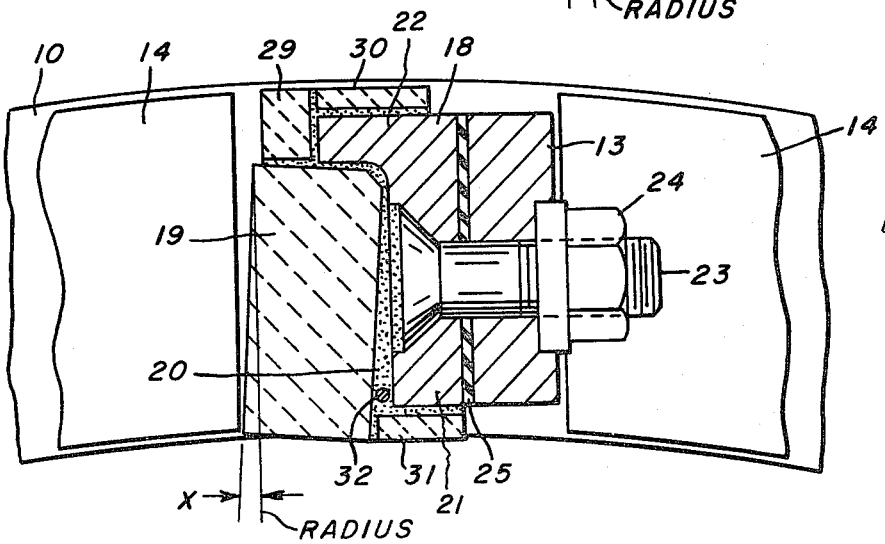
FIG. 3.

STRIKER BAR FOR ROTARY CAGE GRINDER

This is a continuation of application Ser. No. 669,537, filed Mar. 23, 1976, now abandoned, which in turn is a continuationof application Ser. No. 564,943, filed Apr. 3, 1975, now abandoned.

This invention relates to an improved striker bar for a rotary cage impact grinder.

Our striker bar is an improvement over the striker bars shown in Meger et al U.S. Pat. Nos. 3,047,243 and 3,355,113. The disclosures of both the Meger et al patents are incorporated herein by reference.

The earlier Meger et al patent shows a grinder or disintegrating mill which includes a housing and a pair of concentric cages journaled within the housing and driven to rotate in opposite directions. Each cage has a pair of spaced supporting rings and a plurality of circumferentially and radially spaced striker bars extending between the rings. Coarse material, such as coal, coke or ore, is fed to the central portion of the housing and is thrown outwardly by centrifugal force against the striker bars of the rotating cages, which are subject to severe wear, and are made to be removed and replaced readily. The later Meger et al patent shows a striker bar said to be an improvement over the earlier in that it possesses greater wear life.

Conventionally striker bars have been formed of hard metal, commonly white cast iron ("Nihard"). Attempts have been made to form the bars of hard ceramic which is more abrasion-resistant than metal, but such attempts have not been successful. Severe stresses, which result from impact of the material against the striker bars, have broken the bars loose. Mechanical attaching means, such as bolts which extend through holes in the ceramic, also weaken the brittle ceramic and cause it to break. If a piece of hard ceramic is loose in the grinder, any part that it strikes is quickly destroyed.

An object of our invention is to provide an improved striker bar for a rotary cage grinder, the impact-receiving portions of which are formed of an abrasion-resistant ceramic, but which overcomes difficulties encountered heretofore.

A more specific object is to provide an improved striker bar which includes an angle iron mounting and a block of abrasion-resistant ceramic, preferably formed in sections abutting end-to-end, adhesively affixed to the mounting in a way to assure that the block remains in place with little likelihood of breaking.

In the drawing.

FIG. 1 is a perspective view of a portion of a grinder cage equipped with our improved striker bar;

FIG. 2 is a section on line II—II of FIG. 1; and

FIG. 3 is a section similar to FIG. 2, but showing a modification.

FIG. 1 shows a portion of a rotary cage which includes a pair of spaced supporting rings 10 and 12, a plurality of structural members 13 extending between the rings and affixed thereto, as by welding, and wear plates 14 affixed to the opposed inner faces of the rings. Respective striker bars 15, constructed in accordance with our invention, are removably attached to the structural members 13. The remainder of the grinder is not shown, but may be similar to the grinder shown in the earlier Meger et al patent. The cage illustrated rotates in a counterclockwise direction.

As best shown in FIG. 2, the striker bar 15 comprises an angle iron mounting 18 and a block 19 of abrasion-resistant ceramic affixed within the angle iron by a layer of adhesive 20. Preferably we form the block 19 in several sections abutting end-to-end (FIG. 1) to relieve stresses and to achieve a more economical design. The angle iron 18 has radial and circumferential legs 21 and 22. The radial leg 21 carries bolts 23, the heads of which preferably are countersunk in the leg and welded thereto. The angle iron legs preferably have a thickness of at least $\frac{1}{2}$ or $\frac{5}{8}$ inch for rigidity and to make it possible to countersink the bolt heads. The bolts extend through holes in the structural member 13 and are removably attached thereto with nuts 24. Preferably we interpose a resilient gasket 25 of rubber or the like between the radial leg 21 and the structural member 13 to permit limited flexing of the striker bar under impact. We orient the striker bar so that the circumferential leg 22 is at the outer circumference of the rings 10 and 12 and the block 19 is at the inner circumference facing toward the direction of travel. The exposed face of the block makes a small angle x with the radius of the ring, commonly about 3° to 10°. Preferably a protective strip 26 of abrasion-resistant ceramic overlies the otherwise exposed radial face of the leg 22 is adhesively affixed to this leg and to the block 19. Preferably we form the strip 26 in sections of similar length to those of the block.

FIG. 3 shows a modified form of striker bar, which presently is our preferred form. The angle iron mounting 18, block 19, adhesive layer 20, bolts 23, nuts 24 and gasket 25 are similar to corresponding parts in the form shown in FIG. 2; hence we do not repeat the description. In the form shown in FIG. 3, a somewhat wider adhesively affixed protective strip 29 overlies the otherwise exposed radial face of the circumferential leg 22 of the angle iron. A second adhesively affixed protective strip 30 overlies the outer face of the circumferential leg 22, and a third such strip 31 overlies the inner circumferential face of the radial leg 21. Strips 29, 30 and 31 likewise are of abrasion-resistant ceramic and preferably are formed in sections. In this manner the otherwise exposed faces of the angle iron 18 are fully encased in abrasion-resistant ceramic, which serves also to protect the structural member 13 from abrasive action of material. We also interpose a spacer bar 32 between the block 19 and the leg 21 of the angle iron.

The ceramic used in block 19 and the various protective strips is one which is highly resistant to abrasion under impact of pieces of material fed to the grinder. Examples are aluminum oxide, silicon carbide, and tungsten carbide. The adhesive used in the layer 20 and to retain the strips is one which assures a strong bond between the ceramic and the metal surfaces and does not break loose under high centrifugal stress and repeated impacts. We prefer an epoxy, of which numerous preparations are available commercially. One example of a commercially available epoxy preparation we have used successfully is EC 2086 of Minnesota Mining and Manufacturing Company.

From the foregoing description, it is seen that our invention provides an improved striker bar, the impact-receiving portions of which are formed of a highly abrasion-resistant ceramic. The ceramic is affixed to the angle iron mounting with an adhesive which assures that the ceramic remains in place. There are no mechanical attaching means passing through the ceramic to weaken it. A rotary cage grinder produces a product ground to the desired fineness only when the impact-receiving surfaces of the striker bars lie at proper angles. With our invention the impact-receiving surfaces maintain their original angles through much longer use than is possible with metal striker bars. Since the ceramic is more abrasion-resistant than metal, both operating casualties and downtime are reduced. The longer life of ceramic striker bars prevents premature wear of the structural members which support the striker bars. As metal striker bars wear, they expose the supporting structural members to impacts of material being ground, thus shortening the life of these members.

We claim:

1. A striker bar for a rotary cage grinder, said bar comprising a metal mounting having an impact-receiving portion, a block of abrasion resistant aluminum oxide covering said mounting at the impact-receiving portion, epoxy adhesive affixing said block to said mounting, and means on said mounting for removably attaching the bar to a cage.

2. A striker bar as defined in claim 1 in which said mounting has two angularly related legs overlying two faces of said block.

3. A striker bar as defined in claim 2 in which the legs of said mounting have a minimum thickness of ½ inch and said attaching means includes bolts having heads countersunk in one of the legs of said mounting.

* * * * *